US009706867B1

(12) United States Patent
Brett

(10) Patent No.: US 9,706,867 B1
(45) Date of Patent: Jul. 18, 2017

(54) JEWELRY HELPER

(71) Applicant: Alison Brett, Toronto (CA)

(72) Inventor: Alison Brett, Toronto (CA)

( * ) Notice: Subject to any disclaimer, the term of this patent is extended or adjusted under 35 U.S.C. 154(b) by 0 days.

(21) Appl. No.: 15/209,649

(22) Filed: Jul. 13, 2016

Related U.S. Application Data

(60) Provisional application No. 62/212,801, filed on Sep. 1, 2015.

(51) Int. Cl.
*A47G 25/90* (2006.01)
*A45C 11/16* (2006.01)

(52) U.S. Cl.
CPC ..... *A47G 25/901* (2013.01); *A45C 11/16* (2013.01)

(58) Field of Classification Search
CPC ..... A47G 25/901; A45C 11/16
See application file for complete search history.

(56) References Cited

U.S. PATENT DOCUMENTS 2,892,541 A * 6/1959 Hahn ..... A47F 7/02 206/470
2,896,890 A * 7/1959 Hlavac ..... A47G 25/901 248/122.1
2,926,875 A * 3/1960 Hoye ..... A47G 25/901 248/121
4,650,141 A * 3/1987 Longo ..... A47G 25/901 248/118
4,734,973 A * 4/1988 Longo ..... A47G 25/901 269/37
4,779,312 A * 10/1988 Carlson ..... A47G 25/901 24/3.2
5,405,066 A * 4/1995 Fakier ..... A47G 25/901 223/111
6,095,346 A * 8/2000 Idelberger ..... A47F 7/02 211/85.2
7,284,684 B1 * 10/2007 Gharavi ..... A47G 25/901 223/111
D604,028 S * 11/2009 McCluhan ..... D2/641
2008/0251549 A1 * 10/2008 McCluhan ..... A47G 25/901 223/111
2010/0276462 A1 * 11/2010 Ionis ..... A47G 25/901 223/111

* cited by examiner

*Primary Examiner* — Shaun R Hurley
*Assistant Examiner* — Andrew W Sutton
(74) *Attorney, Agent, or Firm* — RG Patent Consulting, LLC; Rachel Gilboy

(57) ABSTRACT

A jewelry attachment device having a main body including a main platform that a person can rest their wrist or forearm thereon, and a clasp stand adjustably connected to the main body that includes a slot, such that a person can place a jewelry clasp member within the slot of the clasp stand in an opened position, place a jewelry item and their wrist or forearm upon the main platform, adjust the position of the clasp stand, and then connect with one hand a ring loop portion of the jewelry item to the jewelry clasp member.

13 Claims, 4 Drawing Sheets

JEWELRY HELPER

CROSS-REFERENCE TO RELATED APPLICATION

The present application is related to and claims priority from prior provisional patent application Ser. No. 62/212,801 filed on Sep. 1, 2015, which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of jewelry and apparatuses aiding a user to attach jewelry to a person's body.

2. Description of the Related Art

Throughout the history of jewelry and attachment means and devices thereof there has always been the inherent problem of needing two hands to attach jewelry pieces that incorporates clasps as the means to removably attached ends thereof. However, one hand with one hand always seems unusable since it needs to be in position to receive the piece of jewelry on one's wrist. And, when trying to attach ends with one hand it is nearly impossible to hold open the clasp and place the attachment member on the other end into the open clasp at the same time.

Thus, a need exists for a reliable jewelry helper to help to hold open the clasp of the jewelry member while one's other hand grabs the end of the jewelry item and attaches it to the open clasp.

BRIEF SUMMARY OF THE INVENTION

In view of the foregoing disadvantages inherent in the known jewelry art, the present invention provides a novel solution.

The instant invention sets forth a jewelry attachment device comprising a main body including an elongated top surface; a saddle platform connected to the top surface and adapted such that a person can rest their wrist or forearm thereon; a clasp stand adjustably connected to the main body and including a slot therein adapted to hold a clasp of a jewelry item and wherein the clasp stand is adapted to move with respect to the saddle platform and extend above the top surface of the main body, and wherein the jewelry attachment device is adapted such that a person can place a jewelry clasp member within the slot of the clasp stand in an opened position, place a jewelry item and their wrist or forearm upon said saddle platform, adjust the position of the clasp stand, and then connect with one hand a ring loop portion of the jewelry item to the jewelry clasp member. The method of use for the present invention is also disclosed herein.

BRIEF DESCRIPTION OF THE DRAWINGS

The figures which accompany the written portion of this specification illustrate embodiments and method(s) of use for the present invention, a jewelry helper, constructed and operative according to the teachings of the present invention.

The various embodiments of the present invention will hereinafter be described in conjunction with the appended drawings, wherein like designations denote like elements.

DETAILED DESCRIPTION

Figure 1:
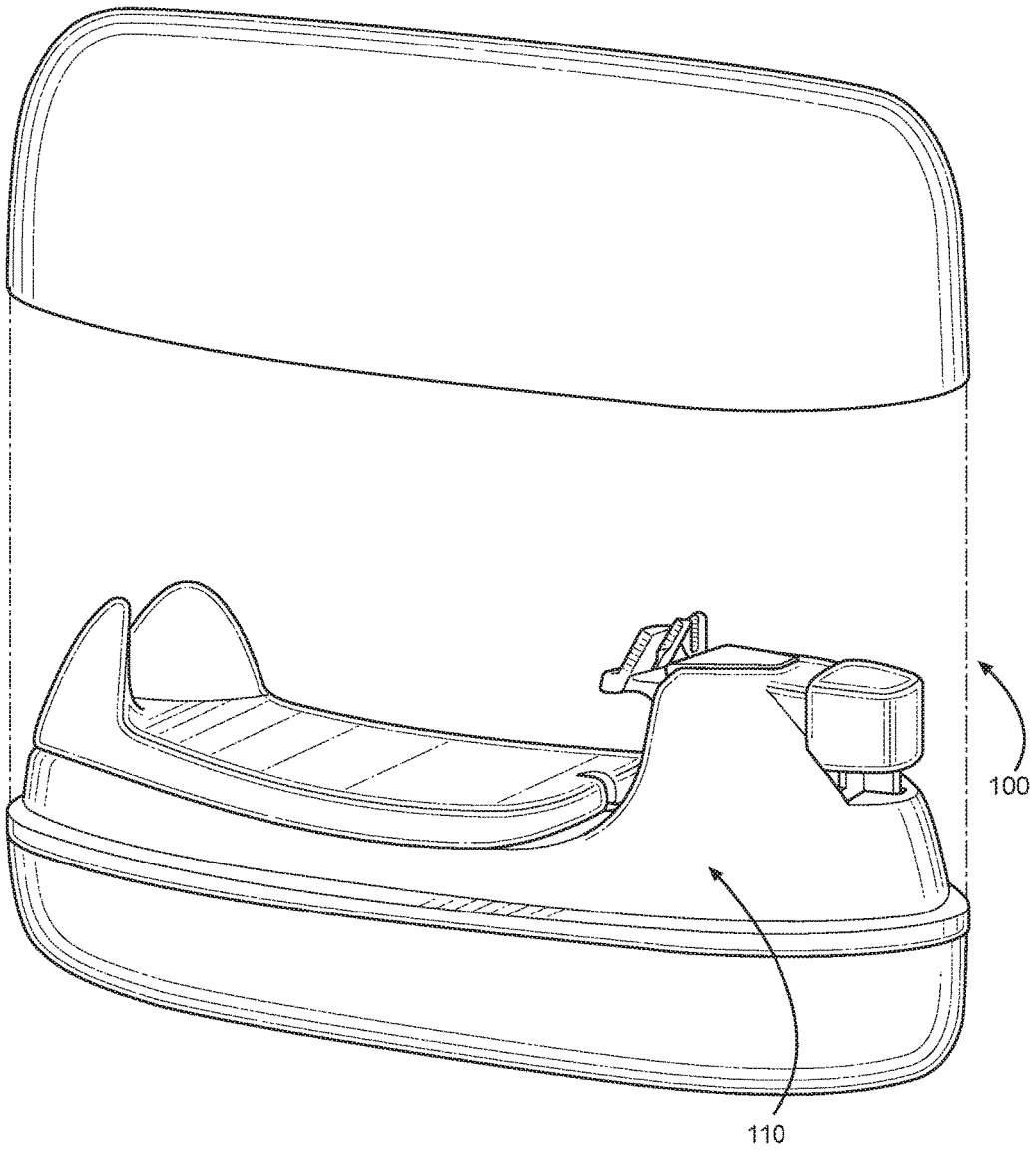
FIG. 1 shows a perspective view illustrating a jewelry helper according to an embodiment of the present invention.

Referring to the drawings by numerals of reference there is shown in FIGS. 1-4, perspective views illustrating a jewelry attachment device 100 comprising a main body 110 including an elongated top surface 120; a saddle platform 130 connected to the top surface and adapted such that a person can rest their wrist or forearm thereon; a clasp stand 140 adjustably connected to the main body and including a slot 150 therein adapted to hold a clasp 155 of a jewelry item and wherein the clasp stand is adapted to move with respect to the saddle platform 130 and extend above the top surface of said main body 130, and wherein the jewelry attachment device is adapted such that a person can place a jewelry clasp member within the slot 150 of the clasp stand 140 in an opened position, place a jewelry item and their wrist or forearm upon said saddle platform, adjust the position of the clasp stand 140, and then connect with one hand a ring loop portion of the jewelry item to the jewelry clasp member 155.

Figure 4:
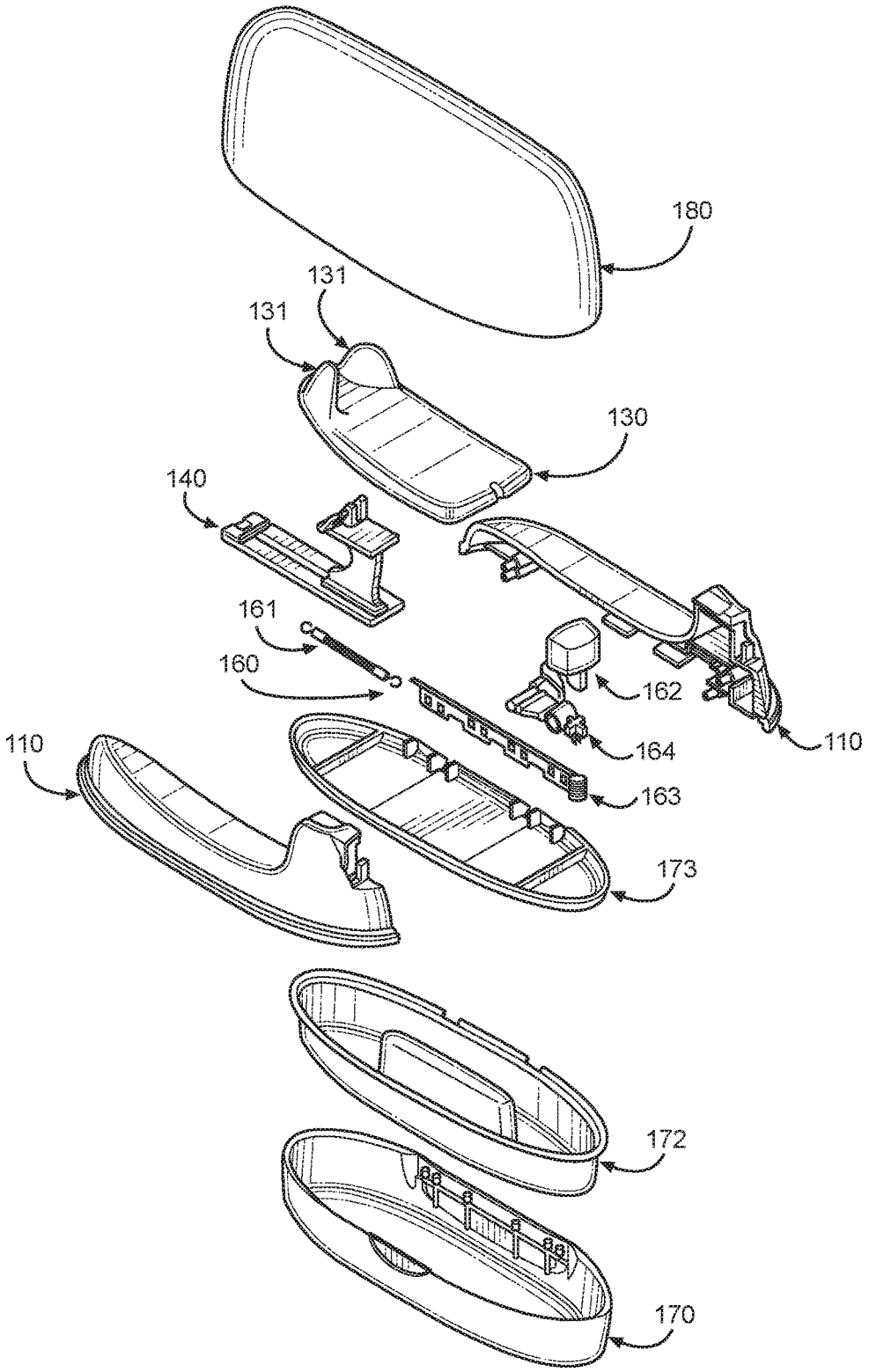
FIG. 4 shows an exploded view illustrating the components of the jewelry helper of FIG. 1.

As best illustrated in FIG. 4, the jewelry attachment device 100 further comprises a ratcheting means 160 connected between the clasp stand 140 and the main body 110, such that said clasp stand 140 can be held in a plurality of positions with respect to the saddle platform 130. wherein said ratcheting means 160 includes a spring member 161 biasing the ratcheting means 160 into a released position, and a release button mechanism 162 connected between the ratcheting means 160 and the main body 110 and adapted to release the clamp stand 140 from the position being held therein and allow the person to remove their wrist or forearm from said jewelry attachment device with said jewelry item connected there around. Furthermore, the ratcheting means 160 can be formed as including a linear ratchet 163 and a ratchet arm 164 for displacing the clamp stand 140 in a linear direction with respect to the saddle platform 130.

The main body 110 further includes a removable base cap member 170 that provides a hollow storage space within said main body 110. And, wherein a tray member 172 having a removable cover 173 thereon may be placed therein to hold jewelry items in storage.

The saddle platform 130 may further include two spaced hump members 131 forming a pocket adapted to support a portion of a jewelry item therein when in use and attaching jewelry items.

A top cap member 180 may be included and is adapted to releasably connect to the top surface of the main body 110 and protect the saddle portion 130 and the clamp stand 140 from damage.

The main body 110 further includes a main hump portion 180 on a distal end thereof having an engagement member 190 thereon adapted to engage with a lever 156 of the jewelry clasp member 155, such that when in use the jewelry clasp member is pressed and held against the engagement member 190 and the lever 155 is held in an open position.

The base cap member 170 and said top cap member 180 are formed from a plastic material, but other materials can be used that are known in the art.

Figure 2:
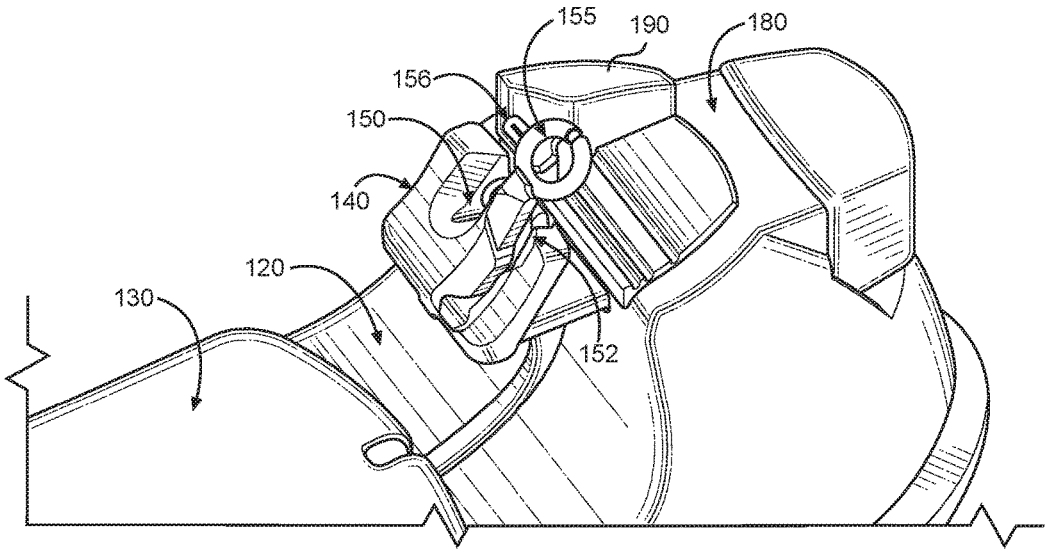
FIG. 2 shows a close up perspective view illustrating the jewelry helper of FIG. 1 and a first type of jewelry clasp member.
Figure 3:
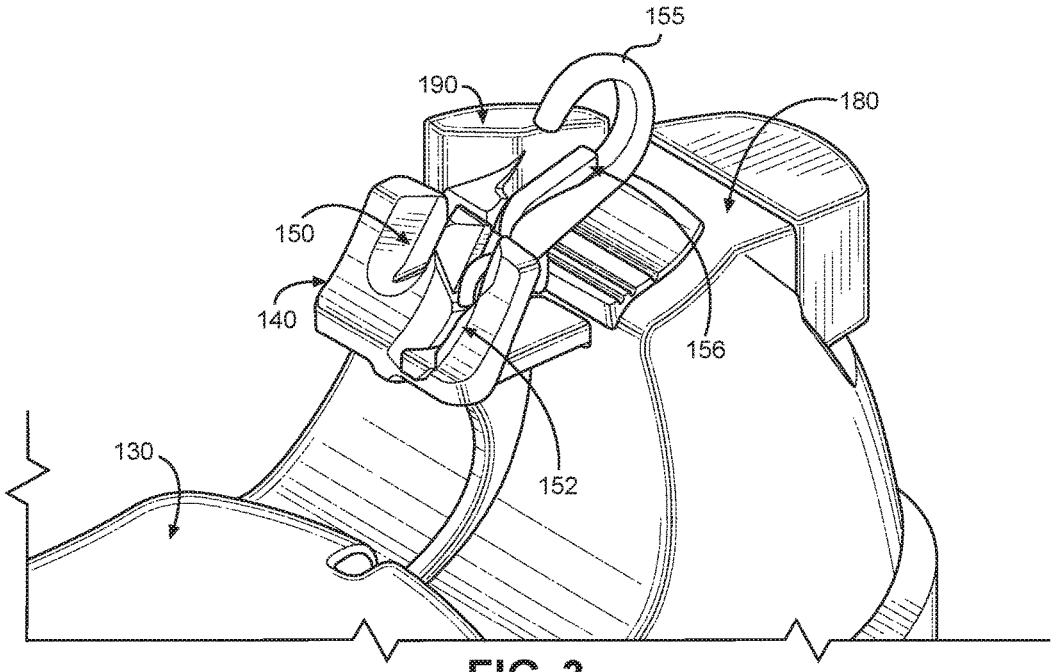
FIG. 3 shows a close up perspective view illustrating the jewelry helper of FIG. 1 and a second type of jewelry clasp member.

As shown in FIGS. 2 and 3, the clamp stand 140 may also include a second slot 152 therein adapted to hold a clasp of a jewelry item 155, such that this second slot 152 is adapted to hold a clasp of a jewelry item in an orientation that is rotated 90 degrees from an orientation of the first clamp stand slot 150. Further, the engagement member 190 includes a plurality of surfaces thereon that are adapted for engagement with levers of different configurations of jewelry clasp members.

Figure 5:
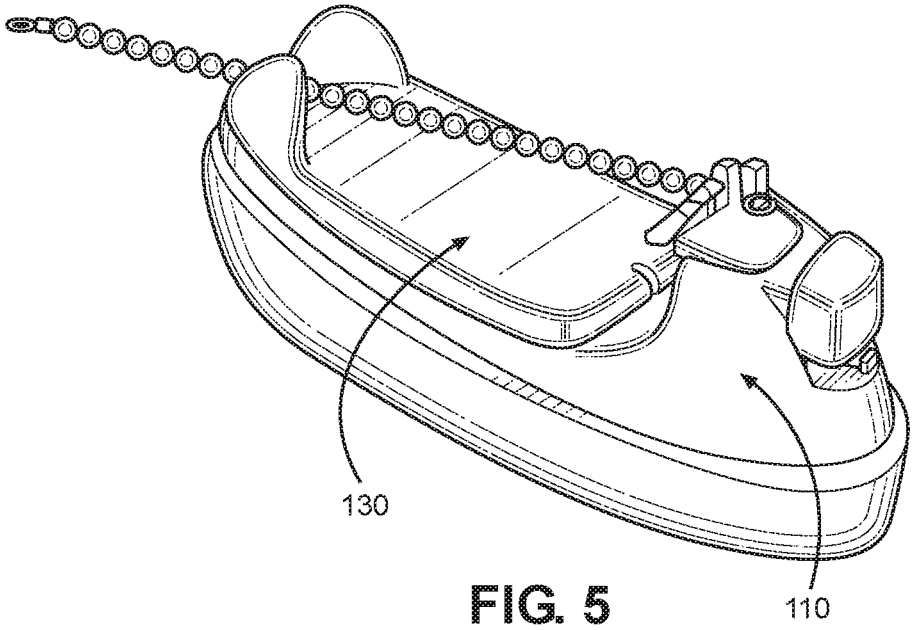
FIG. 5 shows a perspective view illustrating the jewelry helper of FIG. 1 in an in-use condition.
Figure 6:
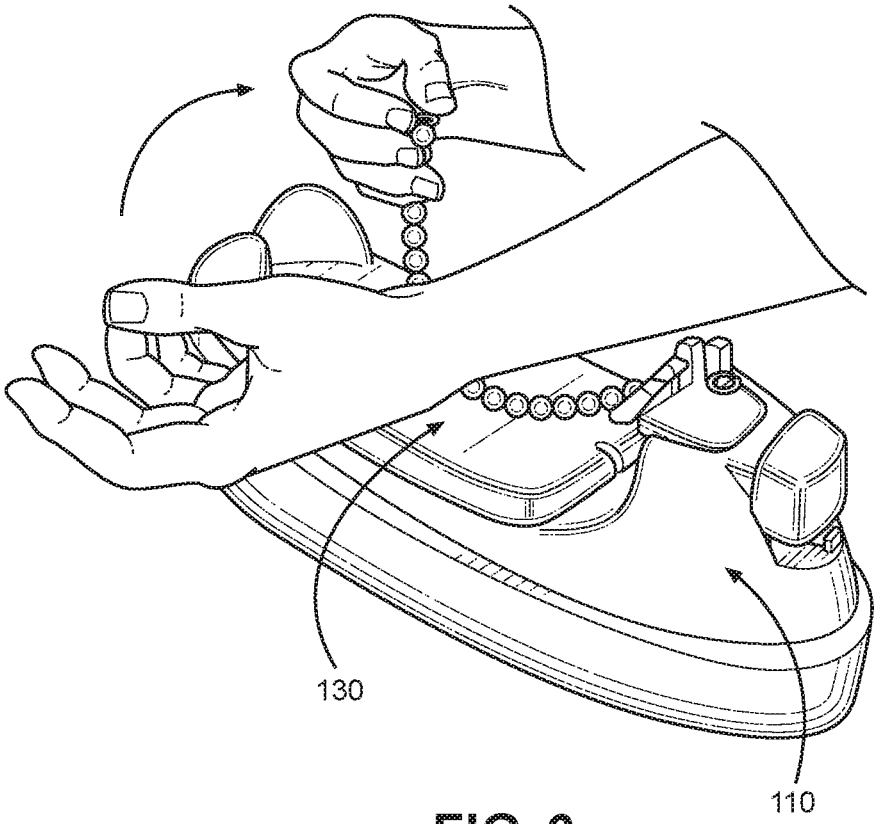
FIG. 6 shows a perspective view illustrating the jewelry helper of FIG. 1 in an in-use condition.

FIGS. 5 and 6 show the jewelry helper in use. The first step is to secure the jewelry item's clasp member into the appropriate slot (150 or 152) within the clasp stand 140, and then adjust the clasp stand 140 such that the lever 156 of the clasp 155 being used is pressed against the appropriate surface of the engagement member 190 such that the clasp is held in an open position. The ratcheting means 160 assures that the clasp stand 140 is removably held in the chosen position. The jewelry item itself should be laid out across the saddle platform 130 such that a person can place their wrist or forearm on top of the jewelry item and the saddle platform 130. The second step is for the person to grab the end of the jewelry item opposite the end attached to the clasp with their free hand, bring it over the top of their wrist and attach it to the open clasp 155. The third step is to release the ratcheting means 160 by pressing the release button mechanism 162, which in turn closes the clasp by moving it away from the engagement member 190 allowing it to close and secure the ends of the jewelry member together. The person is the free to remove their wrist and forearm away from the jewelry helper with the jewelry item thereon.

It should be noted that the steps described in the method of use can be carried out in many different orders according to user preference. The use of "step of" should not be interpreted as "step for", in the claims herein and is not intended to invoke the provisions of 35 U.S.C. §112, 16. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A jewelry attachment device comprising:
- a main body including;
  - an elongated top surface;
- a saddle platform connected to said top surface;
  - wherein said saddle platform is adapted such that a person can rest their wrist or forearm thereon;
- a clasp stand adjustably connected to said main body in proximity to said saddle platform and including;
  - a slot therein adapted to hold a clasp of a jewelry item;
  - wherein said clasp stand is adapted to move with respect to said saddle platform and extend above said top surface of said main body;
- wherein said jewelry attachment device is adapted such that a person can place a jewelry clasp member within said slot of said clasp stand in an opened position; place a jewelry item and their wrist or forearm upon said saddle platform; adjust the position of said clasp stand; and then connect with one hand a ring loop portion of said jewelry item to said jewelry clasp member.

2. The jewelry attachment device of claim 1, further comprising ratcheting means connected between said clasp stand and said main body, such that said clasp stand can be held in a plurality of positions with respect to said saddle platform.

3. The jewelry attachment device of claim 2, wherein said ratcheting means includes a spring member biasing said ratcheting means into a released position.

4. The jewelry attachment device of claim 3, further comprising a release button mechanism connected between said ratcheting means and said main body and adapted to release said clamp stand from the position being held therein and allow said person to remove their wrist or forearm from said jewelry attachment device with said jewelry item connected there around.

5. The jewelry attachment device of claim 2, wherein said ratcheting means is formed as a linear ratchet for displacing said clamp stand in a linear direction with respect to said saddle platform.

6. The jewelry attachment device of claim 1, wherein said main body further includes a removable base cap member that provides a hollow storage space within said main body.

7. The jewelry attachment device of claim 1, wherein said saddle platform includes two spaced hump members forming a pocket adapted to support a jewelry item therein when in use.

8. The jewelry attachment device of claim 1, further comprising top cap member adapted to releasably connect to said top surface of said main body and protect said saddle portion and said clamp stand from damage.

9. The jewelry attachment device of claim 1, wherein said main body further includes a main hump portion on a distal end thereof having an engagement member thereon adapted to engage with a lever of said jewelry clasp member, such that when in use said jewelry clasp member is pressed and held against said engagement member and said lever is held in an open position.

10. The jewelry attachment device of claim 6, wherein said base cap member and said top cap member are formed from a plastic material.

11. The jewelry attachment device of claim 1, wherein said clamp stand further includes a second slot therein adapted to hold a clasp of a jewelry item, such that said second slot is adapted to hold a clasp of a jewelry item in an orientation that is rotated 90 degrees from an orientation said clamp stand slot is adapted to hold a clasp of a jewelry item therein.

12. The jewelry attachment device of claim 9, wherein said engagement member includes a plurality of surfaces thereon adapted for engagement with levers of different configurations of jewelry clasp members.

13. The jewelry attachment device of claim 10, further comprising a tray member adapted to be placed within said base cap member and adapted to hold jewelry items in storage therein.

* * * * *